US006971923B1

(12) United States Patent
Wu

(10) Patent No.: US 6,971,923 B1
(45) Date of Patent: Dec. 6, 2005

(54) CABLE END CONNECTOR ASSEMBLY WITH IMPROVED ORGANIZER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/870,075

(22) Filed: Jun. 16, 2004

(51) Int. Cl.[7] ..... H01R 13/04
(52) U.S. Cl. ..... 439/694; 439/606; 439/902; 439/881
(58) Field of Search ..... 439/694, 606, 439/902, 904, 881

(56) References Cited

U.S. PATENT DOCUMENTS 5,643,005 A * 7/1997 Weidler et al. ..... 439/904
6,402,552 B1 * 6/2002 Wagner ..... 439/606
6,517,368 B2 * 2/2003 Hara et al. ..... 439/904
6,808,410 B1 * 10/2004 Lee ..... 439/606
6,830,472 B1 * 12/2004 Wu ..... 439/358

* cited by examiner

*Primary Examiner*—Tho D. Ta
(74) *Attorney, Agent, or Firm*—Wei Te Chung

(57) ABSTRACT

A cable end connector assembly (100) includes an insulative housing (1) defining a number of passageways (14) therein, a number of contacts (2) received in the housing, and an organizer (3) separably attached to the housing to receive the tail portions of the contacts. Each contact includes a contact portion (20) and an opposite tail portion (24). The organizer has a supporting portion (31) defining an inclined rear surface (3112). The tail portions of the contacts project outside the housing and are bent along the rear surface of the supporting portion so as to arrange the tail portions in a substantially vertical position.

21 Claims, 6 Drawing Sheets

3

CABLE END CONNECTOR ASSEMBLY WITH IMPROVED ORGANIZER

CROSS-REFERENCE TO RELATED APPLICATIONS

This application is related to U.S. patent application filed on Apr. 20, 2004 with unknown serial number and entitled "CABLE END CONNECTOR ASSEMBLY HAVING PULL MECHANISM", U.S. patent application Ser. No. 10/775,524 filed on Feb. 9, 2004 and entitled "CABLE END CONNECTOR ASSEMBLY WITH IMPROVED ORGANIZER", both of which have the same applicant and assignee as the present invention. The disclosure of these related applications is incorporated herein by reference.

BACKGROUND OF THE INVENTION

1. Field of the Invention

The present invention generally relates to a cable end connector assembly, and more particularly to a right angle cable end connector assembly having an organizer.

2. Description of Prior Art

There exits in the art an electrical connector known as a serial Advanced Technology Attachment (serial ATA) connector which is generally used for disk drives and storage peripherals. Especially, the serial ATA connector according to the serial ATA standard are featured in fewer electrical contacts than other conventional electrical connectors and are relatively tiny in configuration. Generally, a right angle serial ATA cabled end connector assembly comprises an elongated housing, a plurality of terminals received in a plurality of terminal-receiving passageways defined in the housing, a plurality of wires and a cover over molded with the housing and the solder joints of the wires and the contacts. Each of the contacts comprises a contact portion retentively retained in the housing and a tail portion exposed beyond a rear end of the housing and bent downwardly at a right angle for soldering with a corresponding conductor of the wire. However, the right angle bent tail portions will outwardly spring back after bending force withdrawn therefrom, so the tail portions can not be soldered with conductors of the wire in a predetermined position, which leads to a poor soldering effect and further adversely affects performance of the cable end connector assembly.

Hence, a right angle cable end connector assembly having an improved organizer is desired to overcome the disadvantages of the prior art.

BRIEF SUMMARY OF THE INVENTION

Accordingly, an object of the present invention is to provide a right angle cable end connector assembly having an improved organizer which can ensure a reliable connecting between contacts and cable.

In order to achieve the above-mentioned object, a cable end connector assembly in accordance with the present invention comprises an insulative housing defining a plurality of passageways therein, a plurality of contacts received in the housing, and an organizer separably attached to the housing to receive the tail portions of the contacts. Each contact includes a contact portion and an opposite tail portion. The organizer has a supporting portion defining an inclined rear surface. The tail portions of the contacts project outside the housing and are bent along the rear surface of the supporting portion so as to arrange the tail portions in a substantially vertical position.

Other objects, advantages and novel features of the invention will become more apparent from the following detailed description of the present embodiment when taken in conjunction with the accompanying drawings.

DETAILED DESCRIPTION OF THE INVENTION

Figure 1:
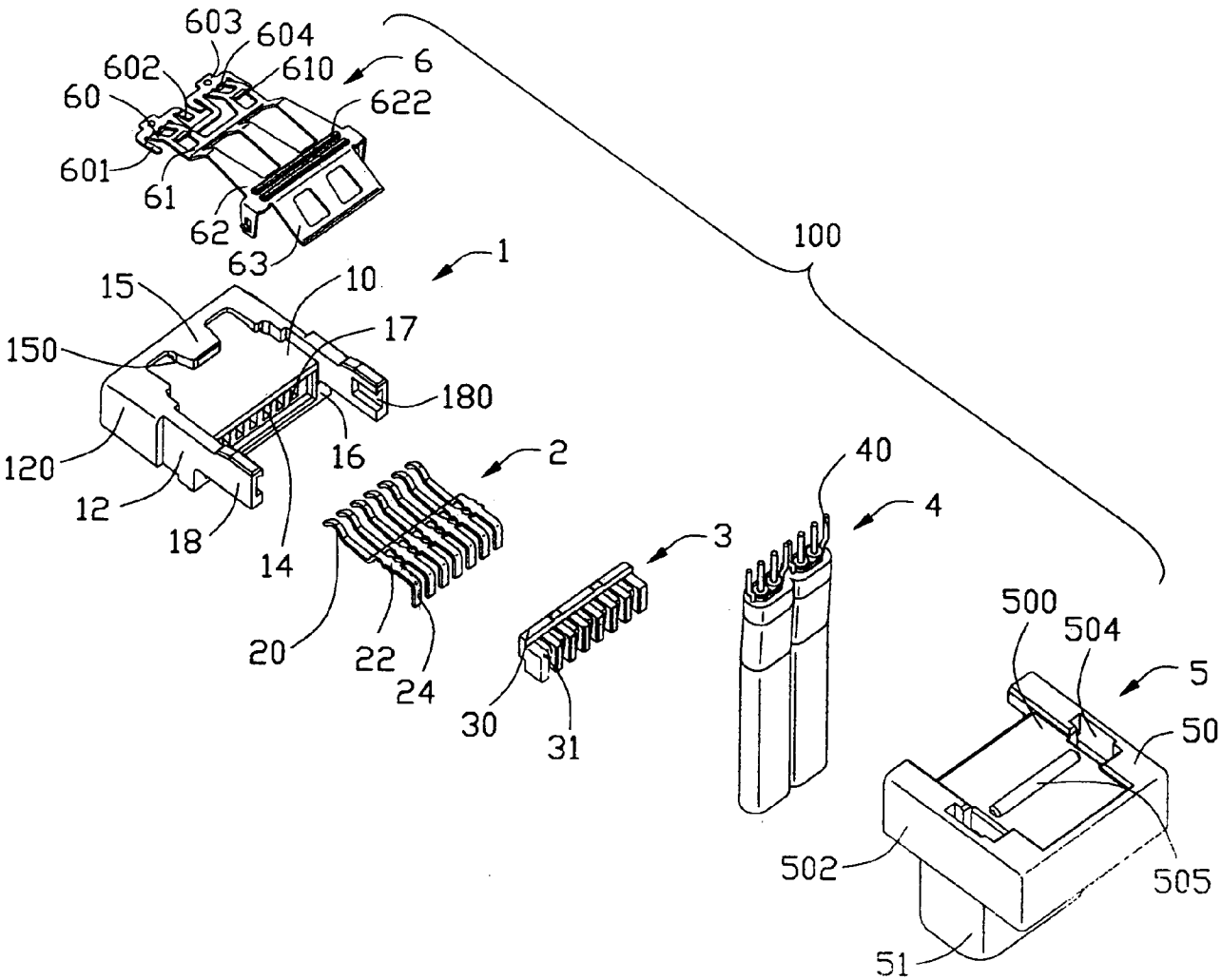
FIG. 1 is an exploded, perspective view of a cable end connector assembly in accordance with the present invention.

Reference will now be made to the drawing figures to describe the present invention in detail.

Figure 2:
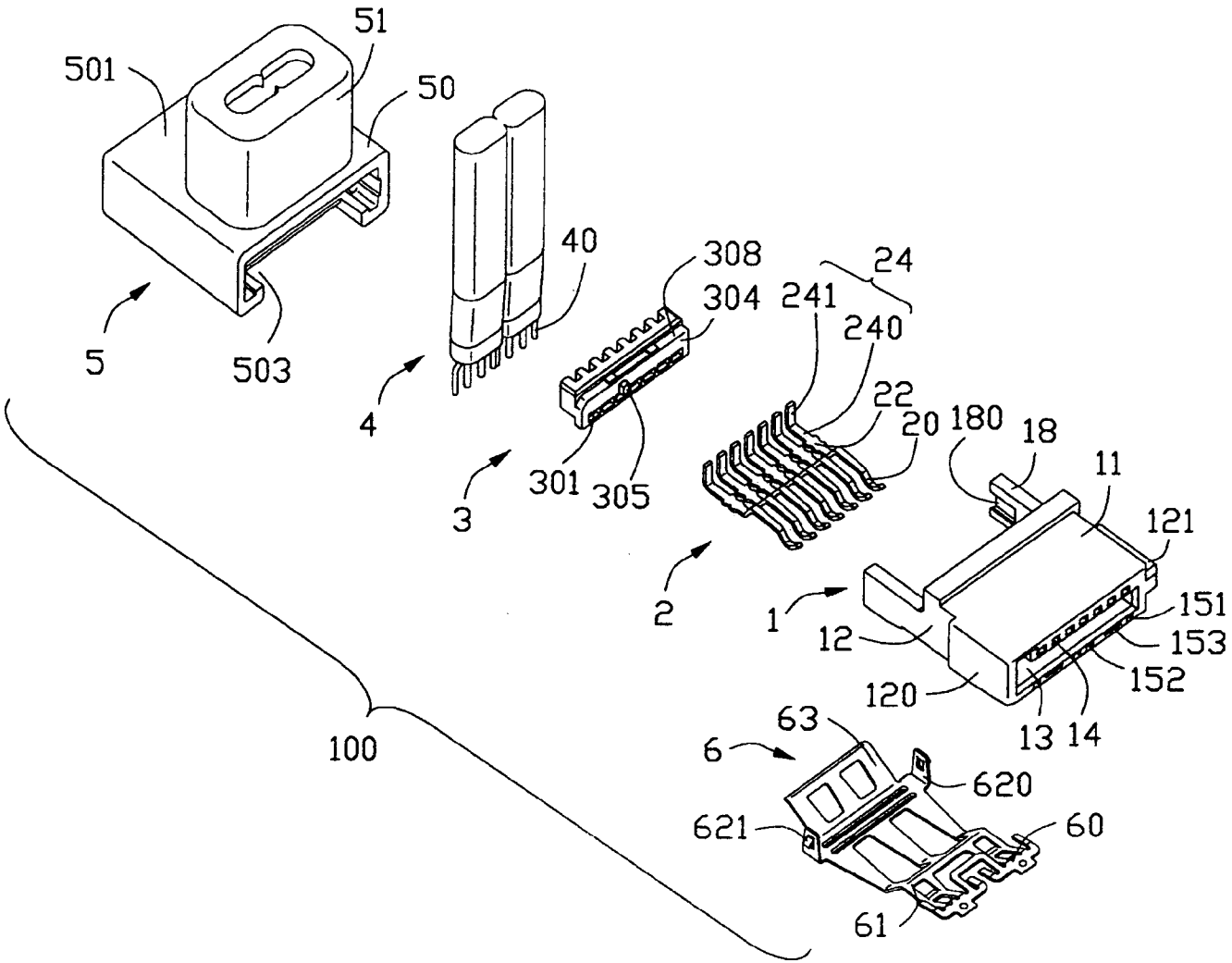
FIG. 2 is a view similar to FIG. 1, but taken from a different aspect.

Referring to FIGS. 1–2, a cable end connector assembly 100 in accordance with the present invention comprises an insulative housing 1, a plurality of contacts 2, an organizer 3, a cable 4, a cover 5, and a locking member 6.

The insulative housing 1 comprises an upper wall 10, a lower wall 11 opposite to the upper wall 10, and a pair of sidewalls 12 connecting with the upper wall 10 and the lower wall 11. The upper wall 10, the lower wall 11 and the sidewalls 12 together define an L-shaped receiving space 13 therebetween. The lower wall 11 defines a plurality of passageways 14 extending therethrough along a front-to-back direction. A rectangular recess 17 is defined in a rear face 16 of the housing 1 in communication with the passageways 14. A flat portion 15 protrudes upwardly and rearwardly from a middle portion of a front flange of the upper wall 10. A gap 150 is formed between the flat portion 15 and a top surface of the upper wall 10. The upper wall 10 defines a pair of first grooves 151, a pair of second grooves 152 and a pair of third grooves 153 at a front portion thereof in communication with the gap 150. One of the sidewalls 12 is integrally formed with an expanded portion 120 for enhancing the strength of the housing 1 thus it can resist breakage when the cable end connector assembly 100 is mating with a complementary connector. A guiding protrusion 121 protrudes outwardly from the other side wall 12. A pair of wing portions 18 respectively extend rearwardly from the sidewalls 12. Each wing portion 18 defines a cutout 180 in a rear portion thereof.

The contacts 2 are respectively disposed in the passageways 14 of the insulative housing 1. Each of the contacts 2 comprises a curved contact portion 20 exposed in a corresponding passageway 14 of the insulative housing 1, a retention portion 22 inferentially retained in the corresponding passageway 14, and a tail portion 24 projecting beyond the rear face 16 of the housing 1. The tail portion 24 is formed with a rearwardly extending connecting portion 240 and a soldering portion 241 downwardly bent from the connecting portion 240.

Figure 3:
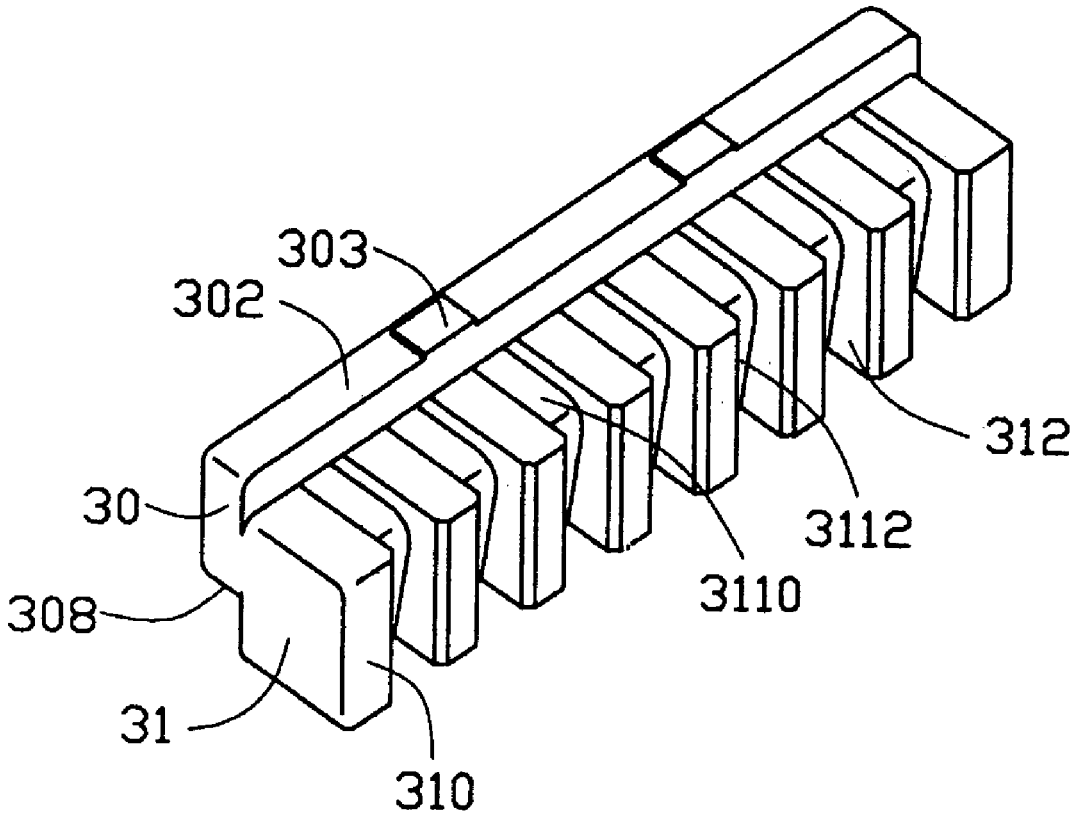
FIG. 3 is an enlarged, perspective view of an organizer shown in FIG. 1.

Particularly referring to FIG. 3, the organizer 3 has a stepped configuration and comprises an elongated base portion 30 and a supporting portion 31 connecting with the base portion 30. The base portion 30 defines a plurality of through holes 301 allowing the tail portions 24 of the contacts 2 passing therethrough. The base portion 30 comprises a positioning protrusion 305 formed in a front face 304 thereof below the through holes 301, and two pairs of projections 303 respectively formed at opposite upper and lower face 302, 308. The supporting portion 31 defines a horizontal top surface 3110 and an adjacent rear surface 3112. The top surface 3110 of the supporting portion 31 is coplanar with bottom inner faces of the through holes 301. The rear surface 3112 is forwardly inclined thus that forming an acute angle with the top surface 3110 of the supporting portion 31. The supporting portion 31 comprises a plurality of parallel spaced partition portions 310 respectively extending along the top surface 3110 and the rear surface of 3112 of the supporting portion 31 for separating the tail portions 24 of the contacts 2 from each other. Each partition portion 310 has a rear face perpendicular to the top surface 3110. Every two adjacent partition portions 310 define a receiving groove 312 therebetween in communication with corresponding through holes 301 of the base portion 30.

The cable 4 comprises a plurality of conductors 40 for being respectively soldered to the tail portions 24 of the contacts 2.

The cover 5 comprises a rectangular body portion 50 and a protective sleeve 51 downwardly extending from a front bottom of the body portion 20. The body portion 50 is formed with a top wall 500, an opposite bottom wall 501, a pair of side walls 502 parallel extending between the top, the bottom walls 500, 501. A receiving cavity 503 is defined between the top and the bottom walls 500, 501 for receiving a rear end of the insulative housing 1. A pair of passages 504 is defined at opposite sides of the top wall 500 in communication with the receiving cavity 503. The top wall 500 further comprises a holding bar 505 between the two passages 504. In order to provide a large enough space for user handling, the protective sleeve 51 should be formed at the most front portion of the cover 5, on condition that the joint portions of the contacts 2 and the cable 4 are well protected.

The locking member 6 is stamped and formed from a metallic plate and comprises a retaining portion 60, a locking portion 61 extending upwardly and rearwardly from the retaining portion 60, a pressing portion 62 extending rearwardly from the locking portion 61, and a supporting portion 63 extending rearwardly and downwardly from the pressing portion 62. The retaining portion 60 has a pair of side tabs 601 extending rearwardly from opposite ends thereof, a pair of snap tabs 602 extending rearwardly and upwardly from a middle portion of a front end thereof, a pair of positioning portions 603 extending forwardly from the front end thereof and a pair of curved portions 604 protruding opposite to the positioning portions 603. The locking portion 61 has a pair of latch tabs 610 protruding upwardly and rearwardly therefrom. The pressing portion 62 is formed with two ribs 622 on a top surface thereof, and a pair of side beams 620 extending downwardly from opposite ends thereof. Each side beam 620 is stamped with a spring tab 621 extending outwardly therefrom.

Figure 4:
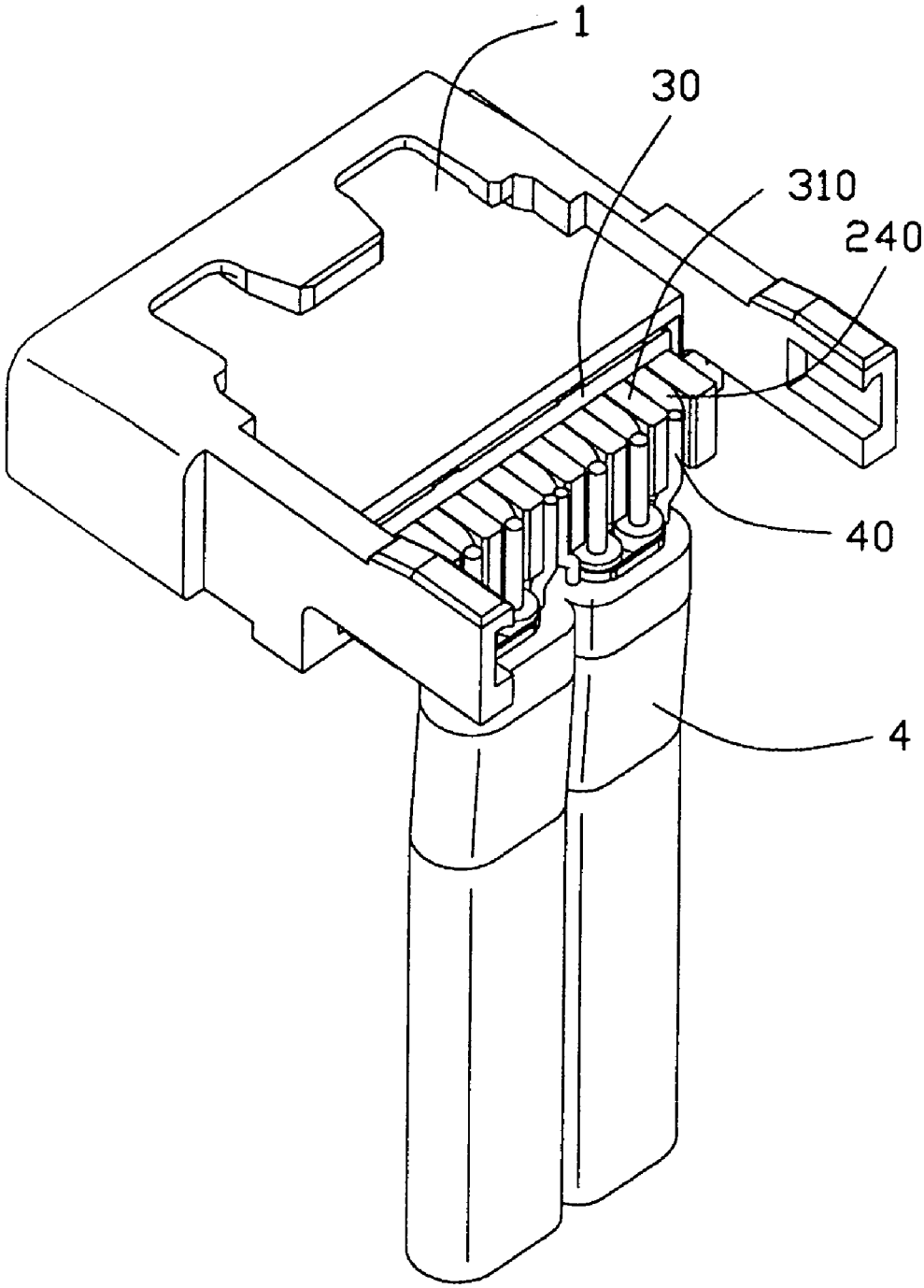
FIG. 4 is a partially assembled view illustrating relationship of the organizer, contacts and a cable of the cable end connector assembly shown in FIG. 1.

Particularly referring to FIG. 4 and in conjunction with FIGS. 1–3, in assembly, the contacts 2 are inserted into the corresponding passageways 14 of the housing 1 before the soldering portion 241 of the tail portions 24 are downwardly bent. The organizer 3 is then assembled to the rear end of the housing 1. The base portion 30 of the organizer 3 is received in the recess 17 of the housing 1, with protrusions 303 interferentially engaged with opposite inner top and bottom surfaces of the recess 17, and with the positioning protrusion 305 completely inserted into a corresponding passageway 14. The tail portions 24 outside the housing 1 pass through the corresponding through holes 301 of the organizer 3 and further extend along the corresponding receiving grooves 312 with connecting portion 240 thereof being juxtaposed on the top surface 3110 of the supporting portion 31. Then the tail portions 24 are downwardly bent along the inclined rear surfaces 3112 of the supporting portion 31 thus that forms the soldering portions 241. During the bending procedure, because the connecting portion 240 of tail portions 24 are supported and restricted within the receiving grooves 312, to bend all of the contacts 2 at a specified angle without left or right offset is more easily achieved. After the bending procedure, the soldering portions 241 of the tail portions 24 rearwardly spring back to a position substantially vertical to the horizontal top surface 3110 of the supporting portion 31 for conductors 40 of the cable 4 overlapping thereto at a predetermined position. The tail portions 24 are still separated from adjacent ones by the associated partition portions 310. A gap is formed between the tail portion 24 and the rear surface 3112 of the supporting portion 31. Thus the conductors 40 of the cable 4 are respectively soldered with the tail portions 24 of the contacts 2 in a substantial vertical direction in a separated manner, and the solder tin fills the gaps between the tail portions 24 and the rear surface 3112, therefore the soldering effect is ensured.

Figure 5:
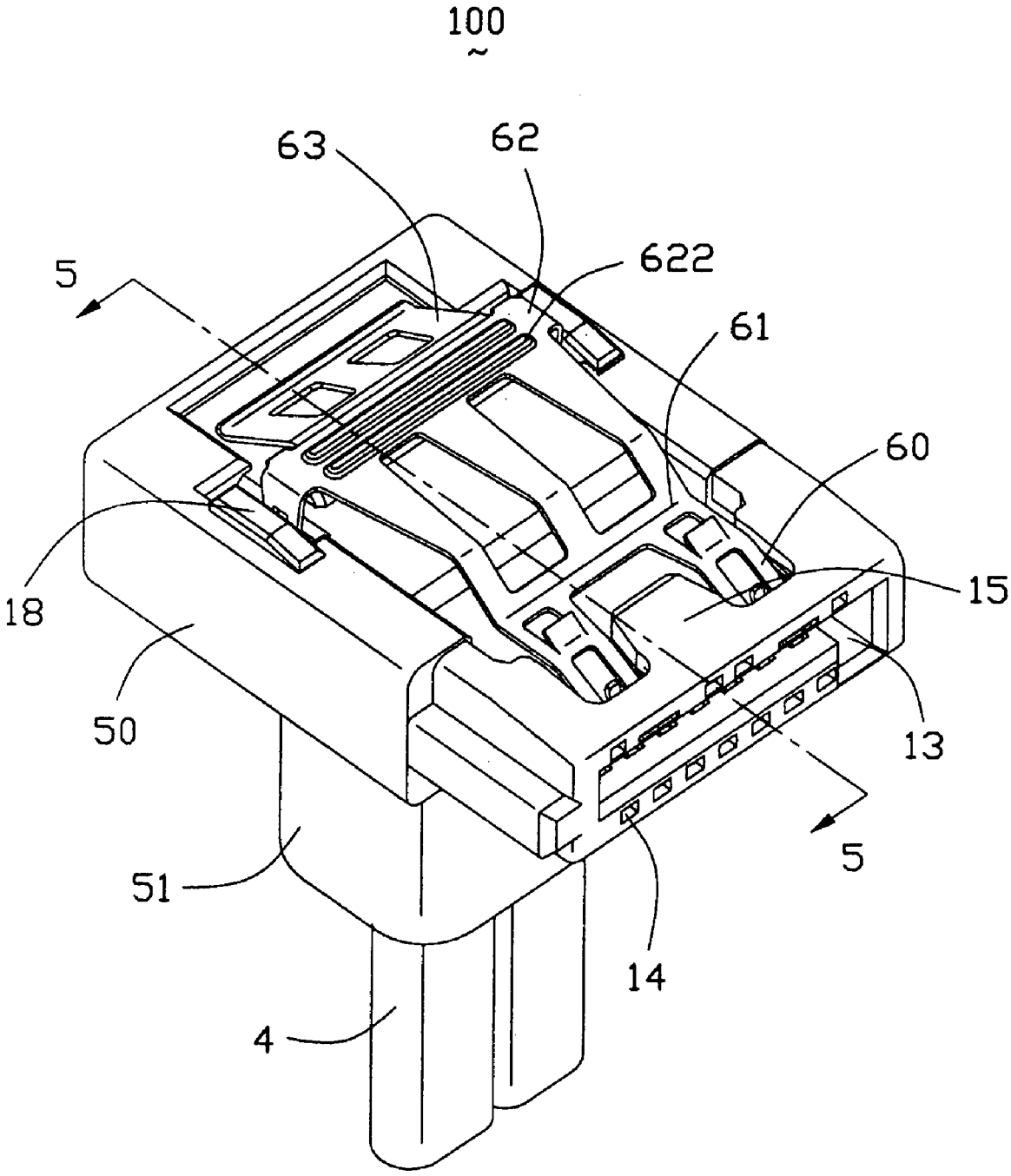
FIG. 5 is an assembled view of the cable end connector assembly shown in FIG. 1.
Figure 6:
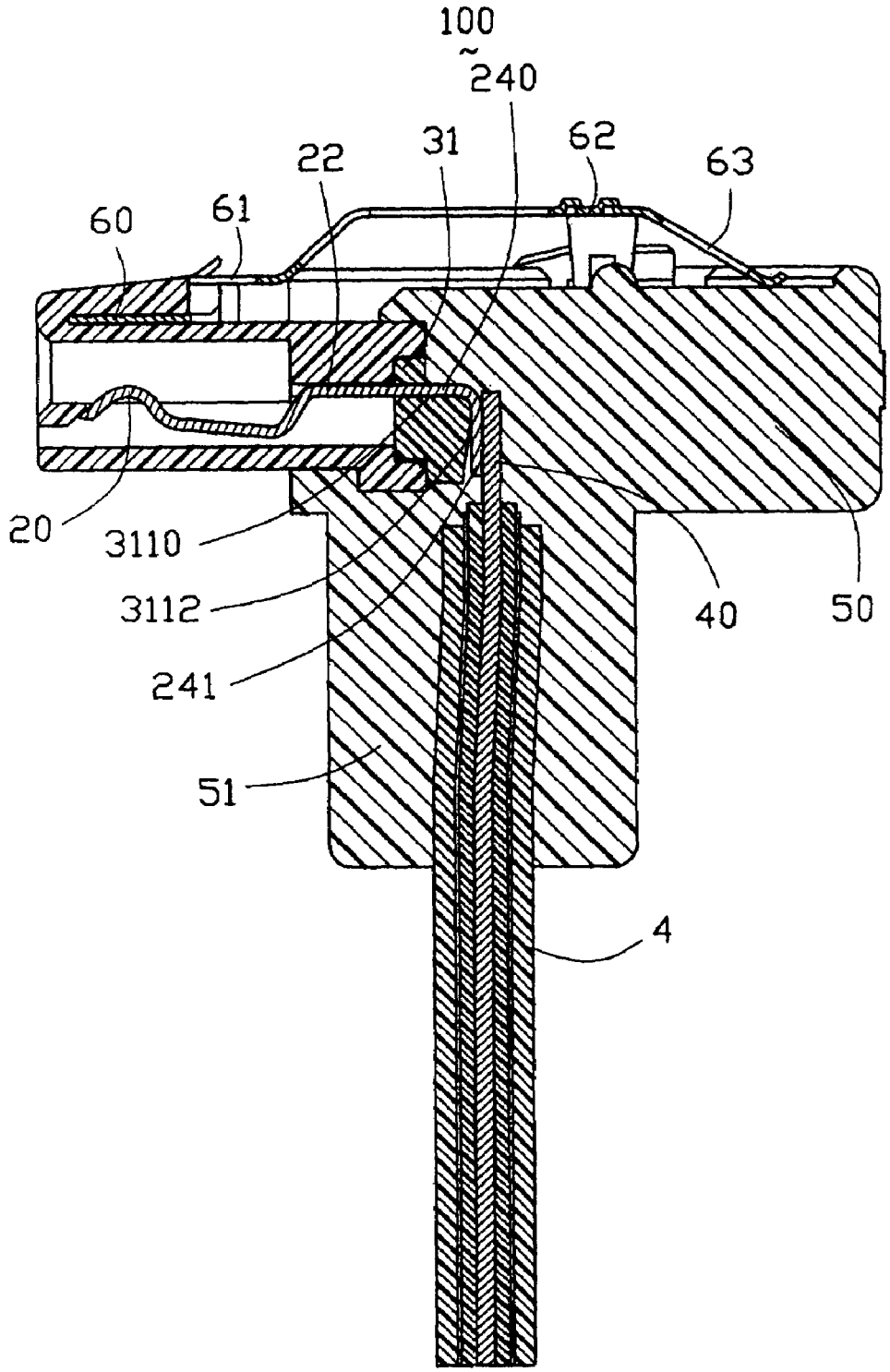
FIG. 6 is a cross-sectional view taken along line 5—5 of FIG. 5.

Referring to FIGS. 5–6 and in conjunction with FIGS. 1–4, the joint portions of the contacts 2 and the cable 4 are over-molded by the protective sleeve 51 of the cover 5. The body portion 50 of the cover 5 is molded over the wing portions 18 of the housing 1. The wing portions 18 are partially exposed beyond the passages 504 of the cover 5. The organizer 3 prevents plastic from seeping into the passageways 14 of the insulative housing 1 during the molding process of the cover 5. The locking member 6 is then assembled to the cover 5 and the housing 1 under a pressing force. The retaining portion 60 of the locking member 6 is pushed into the gap 150 of the housing 1, with the pair of side tabs 601 received in the first grooves 151 of the housing 1, with the pair of snap tabs 602 lockingly received in the second grooves 152, and with the pair of positioning portions 603 inserted into the third grooves 153. The side beams 621 of the pressing portions 62 are respectively partially inserted into the passages 504 with the spring tabs 621 pressed into the cutouts 180 of the wing portions 18 and being slideable therealong. The supporting portion 63 abuts against the top surface of the top wall 500.

When the cable end connector assembly 100 is to be mated with a complementary connector in the front-to-back direction, the user will press the pressing portion 62 of the locking member 6 in cooperation with holding the body portion 50 of the cover 5. The pressing portion 62 of the locking member 6 moves downwardly till contacting with the holding bar 505 of the cover 5. Correspondingly, the latch portion 610 downwardly moves a big enough distance to realize the locking/unlocking between the cable end connector assembly 100 and the complementary connector easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a plurality of passageways;

a plurality of contacts disposed in the insulative housing, each contact comprises a contact portion secured in a corresponding passageway and an opposite tail portion outside the housing; and an organizer separably attached to the housing to receive each tail portion of the contacts, and having a supporting portion such that the tail portion is arranged in a direction substantially perpendicular to a mating direction; and wherein the supporting portion of the organizer defines a horizontal top surface and an adjacent inclined rear surface, and the top surface and the rear surface together forming an acute angle.

2. The electrical connector as claimed in claim 1, wherein the housing comprises an outwardly extending expanded portion at one lateral side thereof.

3. The electrical connector as claimed in claim 1, wherein the organizer forms a positioning protrusion in a front face thereof received in a corresponding passageway of the housing.

4. The electrical connector as claimed in claim 1, wherein the organizer comprises at least two parallel spaced partition portions respectively extending along the top surface and the rear surface of the supporting portion.

5. The electrical connector as claimed in claim 4, wherein the tail portions of the contacts are bent along the rear surface of the supporting portion, and after the bending force is withdrawn therefrom, a gap is defined between the rear surface and the tail portions of the contacts due to spring back of the tail portions.

6. The electrical connector as claimed in claim 4, wherein a receiving groove is defined between the two partition portions for receiving a tail portion of the contact therein.

7. The cable connector assembly as claimed in claim 6, wherein the organizer comprises an elongated base portion defining a plurality of holes therethrough communicating with the receiving groove.

8. The electrical connector as claimed in claim 7, wherein the top surface of the supporting portion of the organizer is flush with bottom inner surfaces of the holes of the base portion.

9. The electrical connector as claimed in claim 7, wherein the housing defines a rectangular recess at a rear end thereof, the base portion of the organizer is fittingly received in the recess.

10. The electrical connector as claimed in claim 9, wherein the base portion has two pairs of protrusions at opposite top and bottom faces thereof interferentially engaging with inner surfaces of the recess.

11. The electrical connector as claimed in claim 1 comprising a cable having a plurality of conductive conductors respectively soldered to the contacts.

12. The electrical connector as claimed in claim 11 comprising an insulative cover enclosing joint portions of the conductors of the cable and the contacts.

13. The electrical connector as claimed in claim 12, wherein the cover comprises a body portion enclosing a portion of the housing and a protective sleeve perpendicularly extending from a front bottom portion of the body portion and enclosing the joint portions of the conductors of the cable and the contacts.

14. The electrical connector as claimed in claims 13, wherein the insulative housing comprises a pair of wing portions extending rearwardly from a rear end thereof, which are enclosed by the body portion of the cover.

15. A method of making an electrical connector, comprising steps of:

providing an insulative housing having a plurality of passageways therein;

providing a plurality of contacts secured in the passageways; and providing an organizer to arrange plural tail portions of the contacts such that the tail portions are substantially supported vertically, and wherein the organizer has a horizontal top surface with tail portions of the contacts juxtaposed thereon and an adjacent inclined rear surface, the top surface and the rear surface together define an acute angle.

16. The method of assembling an electrical connector as claimed in claim 15, wherein the organizer comprises a plurality of partition portions separating the tail portions of the contacts from each other.

17. The method of making an electrical connector as claimed in claim 15 comprising a step of imposing a downward force upon the tail portions of the contacts, tail portions unsupported by the top surface of the organizer thus being bent along the inclined rear surface of the organizer.

18. The method of assembling an electrical connector as claimed in claim 15 further comprising a step of equipping one of the housing and the cover with a locking member.

19. The method of making an electrical connector as claimed in claim 15 further comprising a step of equipping a cable with a plurality of conductors respectively electrically connected to the tail portions of the contacts.

20. The method of malting an electrical connector as claimed in claim 19 comprising a step of equipping a cover enclosing joint portions of the cable and the contacts.

21. An electrical connector, comprising:

an insulative housing defining a plurality of passageways;

a plurality of contacts disposed in the insulative housing, each contact comprising a contact portion secured in a corresponding passageway and an opposite tail portion on a rear portion of the housing and extending in a first direction essentially perpendicular to a mating direction defined by the contact portion;

at least one cable including a plurality of wires connected to the tail portions of the corresponding contacts, respectively, and extending along said first direction; and a cover molded over the rear portion of the housing, and cooperating with the housing and the cable to form a T-shaped configuration; and wherein a deflectable locking member is located on a top portion of the combined housing and cover opposite to the cable in a perpendicular manner.

* * * * *